US008052407B2

(12) United States Patent
Andrady et al.

(10) Patent No.: US 8,052,407 B2
(45) Date of Patent: Nov. 8, 2011

(54) ELECTROSPINNING IN A CONTROLLED GASEOUS ENVIRONMENT

(75) Inventors: Anthony L. Andrady, Apex, NC (US); David S. Ensor, Chapel Hill, NC (US)

(73) Assignee: Research Triangle Institute, Research Triangle Park, NC (US)

( * ) Notice: Subject to any disclaimer, the term of this patent is extended or adjusted under 35 U.S.C. 154(b) by 101 days.

(21) Appl. No.: 11/935,967

(22) Filed: Nov. 6, 2007

(65) Prior Publication Data

US 2008/0063741 A1 Mar. 13, 2008

Related U.S. Application Data

(62) Division of application No. 10/819,945, filed on Apr. 8, 2004, now Pat. No. 7,297,305.

(51) Int. Cl.
*D01D 5/098* (2006.01)

(52) U.S. Cl. ..... 425/72.2; 425/73; 425/174.8 E; 425/382.2; 425/461

(58) Field of Classification Search ..... 425/72.2, 425/73, 174.8 E, 382.2, 461
See application file for complete search history.

(56) References Cited

U.S. PATENT DOCUMENTS

| | | | | |
|---|---|---|---|---|
| 705,691 | A | 7/1902 | Morton | |
| 1,975,504 | A | 10/1934 | Formhals | |
| 2,048,651 | A | 7/1936 | Norton | |
| 2,160,962 | A | 6/1939 | Formhals | |
| 2,168,027 | A * | 8/1939 | Gladding | 425/174 |
| 2,187,306 | A | 1/1940 | Formhals | |
| 2,323,025 | A | 6/1943 | Formhals | |
| 2,338,570 | A | 1/1944 | Childs | |
| 2,349,950 | A | 5/1944 | Formhals | |
| 2,810,426 | A * | 10/1957 | Till et al. | 264/438 |
| 3,280,229 | A | 10/1966 | Simons | |
| 3,475,198 | A | 10/1969 | Drum | |
| 3,490,115 | A | 1/1970 | Owens et al. | |
| 3,670,486 | A | 6/1972 | Murray, Jr. | |
| 3,689,608 | A | 9/1972 | Hollberg et al. | |
| 3,901,012 | A | 8/1975 | Safar | |
| 3,994,258 | A | 11/1976 | Simm | |
| 4,044,404 | A | 8/1977 | Martin et al. | |

(Continued)

FOREIGN PATENT DOCUMENTS

EP 1 217 107 A1 6/2002

(Continued)

OTHER PUBLICATIONS

Ravindran Periasamy, et al. "Generation of Uniformly Sized, Charged Particles in a Vacuum", Aerosol Science and Technology (1991), pp. 256-265.

(Continued)

*Primary Examiner* — Yogendra Gupta
*Assistant Examiner* — Joseph Leyson
(74) *Attorney, Agent, or Firm* — Oblon, Spivak, McClelland, Maier & Neustadt, L.L.P.

(57) ABSTRACT

Apparatus and method for producing fibrous materials in which the apparatus includes an electrospinning element configured to electrospin a substance from which the fibers are to be composed by an electric field extraction of the substance from a tip of the electrospinning element, a collector disposed from the electrospinning element and configured to collect the fibers, a chamber enclosing the collector and the electrospinning element, and a control mechanism configured to control a gaseous environment in which the fibers are to be electrospun.

38 Claims, 6 Drawing Sheets

U.S. PATENT DOCUMENTS

| | | | | |
|---|---|---|---|---|
| 4,127,706 | A | 11/1978 | Martin et al. | |
| 4,230,650 | A | 10/1980 | Guignard | |
| 4,323,525 | A | 4/1982 | Bornat | |
| 4,345,414 | A | 8/1982 | Bornat et al. | |
| 4,468,922 | A | 9/1984 | McCrady et al. | |
| 4,486,365 | A | 12/1984 | Kliemann et al. | |
| 4,552,707 | A | 11/1985 | How | |
| 4,618,524 | A | 10/1986 | Groitzsch et al. | |
| 4,689,186 | A | 8/1987 | Bornat | |
| 4,878,908 | A | 11/1989 | Martin et al. | |
| 4,965,110 | A | 10/1990 | Berry | |
| 5,024,789 | A | 6/1991 | Berry | |
| 5,088,807 | A | 2/1992 | Waters et al. | |
| 5,522,879 | A | 6/1996 | Scopelianos | |
| 5,866,217 | A | 2/1999 | Stenoien et al. | |
| 6,099,960 | A | 8/2000 | Tennent et al. | |
| 6,106,913 | A | 8/2000 | Scardino et al. | |
| 6,110,590 | A | 8/2000 | Zarkoob et al. | |
| 6,265,333 | B1 | 7/2001 | Dzenis et al. | |
| 6,265,466 | B1 | 7/2001 | Glatkowski et al. | |
| 6,306,424 | B1 | 10/2001 | Vyakarnam et al. | |
| 6,308,509 | B1 | 10/2001 | Scardino et al. | |
| 6,375,886 | B1 | 4/2002 | Angadjivand et al. | |
| 6,382,526 | B1 | 5/2002 | Reneker et al. | |
| 6,395,046 | B1 | 5/2002 | Emig et al. | |
| 6,486,379 | B1 | 11/2002 | Chen et al. | |
| 6,492,574 | B1 | 12/2002 | Chen et al. | |
| 6,520,425 | B1 | 2/2003 | Reneker | |
| 6,554,881 | B1 | 4/2003 | Healey | |
| 6,558,422 | B1 | 5/2003 | Baker et al. | |
| 6,667,099 | B1 | 12/2003 | Greiner et al. | |
| 7,762,801 | B2 * | 7/2010 | Andrady et al. | 425/72.2 |
| 2001/0045547 | A1 | 11/2001 | Senecal et al. | |
| 2002/0007869 | A1 | 1/2002 | Pui et al. | |
| 2002/0042128 | A1 | 4/2002 | Bowlin et al. | |
| 2002/0084178 | A1 | 7/2002 | Dubson et al. | |
| 2002/0090725 | A1 | 7/2002 | Simpson et al. | |
| 2002/0100725 | A1 | 8/2002 | Lee et al. | |
| 2002/0122840 | A1 | 9/2002 | Lee et al. | |
| 2002/0124953 | A1 | 9/2002 | Sennett et al. | |
| 2002/0128680 | A1 | 9/2002 | Pavlovic | |
| 2002/0150669 | A1 | 10/2002 | Pui et al. | |
| 2002/0173213 | A1 | 11/2002 | Chu et al. | |
| 2002/0175449 | A1 | 11/2002 | Chu et al. | |
| 2003/0017208 | A1 | 1/2003 | Ignatious et al. | |
| 2003/0054035 | A1 | 3/2003 | Chu et al. | |
| 2003/0100944 | A1 | 5/2003 | Laksin et al. | |
| 2003/0106294 | A1 | 6/2003 | Chung et al. | |
| 2004/0070118 | A1 | 4/2004 | Czado | |
| 2005/0224998 | A1 | 10/2005 | Andrady et al. | |

FOREIGN PATENT DOCUMENTS

| | | | |
|---|---|---|---|
| EP | 1 226 795 | A2 | 7/2002 |
| EP | 1 277 857 | A1 | 1/2003 |
| JP | 2002-201559 | | 7/2002 |
| JP | 2002-249966 | | 9/2002 |
| WO | WO 98/03267 | | 1/1998 |
| WO | WO 98/56894 | | 12/1998 |
| WO | WO 00/22207 | | 4/2000 |
| WO | WO 01/09414 | A1 | 2/2001 |
| WO | WO 01/15754 | A1 | 3/2001 |
| WO | WO 01/26610 | A1 | 4/2001 |
| WO | WO 01/26702 | A2 | 4/2001 |
| WO | WO 01/27365 | A1 | 4/2001 |
| WO | WO 01/27368 | A1 | 4/2001 |
| WO | WO 01/51690 | A1 | 7/2001 |
| WO | WO 01/68228 | A1 | 9/2001 |
| WO | WO 01/74431 | A2 | 10/2001 |
| WO | WO 01/89022 | A1 | 11/2001 |
| WO | WO 01/89023 | A1 | 11/2001 |
| WO | WO 02/16680 | A1 | 2/2002 |
| WO | WO 02/34986 | A2 | 5/2002 |
| WO | WO 02/49535 | A2 | 6/2002 |
| WO | WO 02/49536 | A2 | 6/2002 |
| WO | WO 02/49678 | A2 | 6/2002 |
| WO | WO 02/50346 | A1 | 6/2002 |
| WO | WO 02/072937 | A1 | 9/2002 |
| WO | WO 02/074189 | A2 | 9/2002 |
| WO | WO 02/074191 | A2 | 9/2002 |
| WO | WO 02/092339 | A1 | 11/2002 |
| WO | WO 02/092888 | A1 | 11/2002 |
| WO | WO 03/004735 | A1 | 1/2003 |
| WO | WO 03/080905 | A1 | 10/2003 |
| WO | WO 2004/074559 | A1 | 9/2004 |

OTHER PUBLICATIONS

Y.M. Shin, et al. "Experimental Chracterization of Electrospinning: The Electrically Forced Jet and Instabilites", Polymer 42 (2001), pp. 9955-9967.

* cited by examiner

ELECTROSPINNING IN A CONTROLLED GASEOUS ENVIRONMENT

CROSS REFERENCE TO RELATED APPLICATIONS

This application is a divisional of U.S. Ser. No. 10/819,945, filed Apr. 8, 2004, now U.S. Pat. No. 7,297,305, and the entire contents of which are incorporated herein by reference.

This application is related to U.S. application Ser. No. 10/819,916, filed on Apr. 8, 2004, entitled "Electrospinning of Fibers Using a Rotating Spray Head," the entire contents of which are incorporated herein by reference. This application is also related to U.S. application Ser. No. 10/819,942, filed on Apr. 8, 2004, entitled "Electrospray/electrospinning Apparatus and Method," the entire contents of which are incorporated herein by reference.

STATEMENT REGARDING FEDERALLY SPONSORED RESEARCH

The U.S. Government, by the following contract, may have a paid-up license in this invention and the right in limited circumstances to require the patent owner to license others on reasonable terms, as provided for by the terms of DARPA Contract No. 972-01-C-0058.

DISCUSSION OF THE BACKGROUND

1. Field of the Invention

This invention relates to the field of electrospinning fibers from polymer solutions.

2. Background of the Invention

Nanofibers are useful in a variety of fields from clothing industry to military applications. For example, in the biomaterial field, there is a strong interest in developing structures based on nanofibers that provide a scaffolding for tissue growth effectively supporting living cells. In the textile field, there is a strong interest in nanofibers because the nanofibers have a high surface area per unit mass that provides light but highly wear-resistant garments. As a class, carbon nanofibers are being used for example in reinforced composites, in heat management, and in reinforcement of elastomers. Many potential applications for nanofibers are being developed as the ability to manufacture and control the chemical and physical properties improves.

Electrospray/electrospinning techniques can be used to form particles and fibers as small as one nanometer in a principal direction. The phenomenon of electrospray involves the formation of a droplet of polymer melt at an end of a needle, the electric charging of that droplet, and an expulsion of parts of the droplet because of the repulsive electric force due to the electric charges. In electrospraying, a solvent present in the parts of the droplet evaporates and small particles are formed but not fibers. The electrospinning technique is similar to the electrospray technique. However, in electrospinning and during the expulsion, fibers are formed from the liquid as the parts are expelled.

Glass fibers have existed in a sub-micron range for some time. Small micron diameter fibers have been manufactured and used commercially for air filtration applications for more than twenty years. Polymeric melt blown fibers have more recently been produced with diameters less than a micron. Several value-added nonwoven applications, including filtration, barrier fabrics, wipes, personal care, medical and pharmaceutical applications may benefit from the interesting technical properties of nanofibers and nanofiber webs. Electrospun nanofibers have a dimension less than 1 μm in one direction and preferably a dimension less than 100 nm in this direction. Nanofiber webs have typically been applied onto various substrates selected to provide appropriate mechanical properties and to provide complementary functionality to the nanofiber web. In the case of nanofiber filter media, substrates have been selected for pleating, filter fabrication, durability in use, and filter cleaning considerations.

A basic electrospinning apparatus 10 is shown in FIG. 1 for the production of nanofibers. The apparatus 10 produces an electric field 12 that guides a polymer melt or solution 14 extruded from a tip 16 of a needle 18 to an exterior electrode 20. An enclosure/syringe 22 stores the polymer solution 14. Conventionally, one end of a voltage source HV is electrically connected directly to the needle 18, and the other end of the voltage source HV is electrically connected to the exterior electrode 20. The electric field 12 created between the tip 16 and the exterior electrode 20 causes the polymer solution 14 to overcome cohesive forces that hold the polymer solution together. A jet of the polymer is drawn by the electric field 12 from the tip 16 toward the exterior electrode 20 (i.e. electric field extracted), and dries during flight from the needle 18 to the exterior electrode 20 to form polymeric fibers. The fibers are typically collected downstream on the exterior electrode 20.

The electrospinning process has been documented using a variety of polymers. One process of forming nanofibers is described for example in *Structure Formation in Polymeric Fibers*, by D. Salem, Hanser Publishers, 2001, the entire contents of which are incorporated herein by reference. By choosing a suitable polymer and solvent system, nanofibers with diameters less than 1 micron have been made.

Examples of fluids suitable for electrospraying and electrospinning include molten pitch, polymer solutions, polymer melts, polymers that are precursors to ceramics, and/or molten glassy materials. The polymers can include nylon, fluoropolymers, polyolefins, polyimides, polyesters, and other engineering polymers or textile forming polymers. A variety of fluids or materials besides those listed above have been used to make fibers including pure liquids, solutions of fibers, mixtures with small particles and biological polymers. A review and a list of the materials used to make fibers are described in U.S. Patent Application Publications 2002/0090725 A1 and 2002/0100725 A1, and in Huang et al., Composites Science and Technology, vol. 63, 2003, the entire contents of which are incorporated herein by reference. U.S. Patent Appl. Publication No. 2002/0090725 A1 describes biological materials and bio-compatible materials to be electroprocessed, as well as solvents that can be used for these materials. U.S. Patent Appl. Publication No. 2002/0100725 A1 describes, besides the solvents and materials used for nanofibers, the difficulties of large scale production of the nanofibers including the volatilization of solvents in small spaces. Huang et al. give a partial list of materials/solvents that can be used to produce the nanofibers.

Despite the advances in the art, the application of nanofibers has been limited due to the narrow range of processing conditions over which the nano-fibers can be produced. Excursions either stop the electrospinning process or produce particles of electrosprayed material.

SUMMARY OF THE INVENTION

One object of the present invention is to provide an apparatus and a method for improving the process window for production of electrospun fibers.

Another object is to provide an apparatus and a method which produce nano-fibers in a controlled gaseous environment.

Yet another object of the present invention is to promote the electrospinning process by introducing charge carriers into the gaseous environment into which the fibers are electrospun.

Still another object of the present invention is to promote the electrospinning process by controlling the drying rate of the electrospun fibers by controlling the solvent pressure in the gaseous environment into which the fibers are electrospun.

Thus, according to one aspect of the present invention, there is provided a novel apparatus for producing fibers. The apparatus includes an extrusion element configured to electrospin a substance from which the fibers are to be composed by an electric field extraction of the substance from a tip of the extrusion element. The apparatus includes a collector disposed from the extrusion element and configured to collect the fibers, a chamber enclosing the collector and the extrusion element, and a control mechanism configured to control a gaseous environment in which the fibers are to be electrospun.

According to a second aspect of the present invention, there is provided a novel method for producing fibers. The method includes providing a substance from which the fibers are to be composed to a tip of an extrusion element, applying an electric field to the extrusion element in a direction of the tip, controlling a gaseous environment about where the fibers are to be electrospun, and electrospinning the substance from the tip of the extrusion element by an electric field extraction of the substance from the tip into the controlled gaseous environment.

BRIEF DESCRIPTION OF THE DRAWINGS

A more complete appreciation of the present invention and many attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
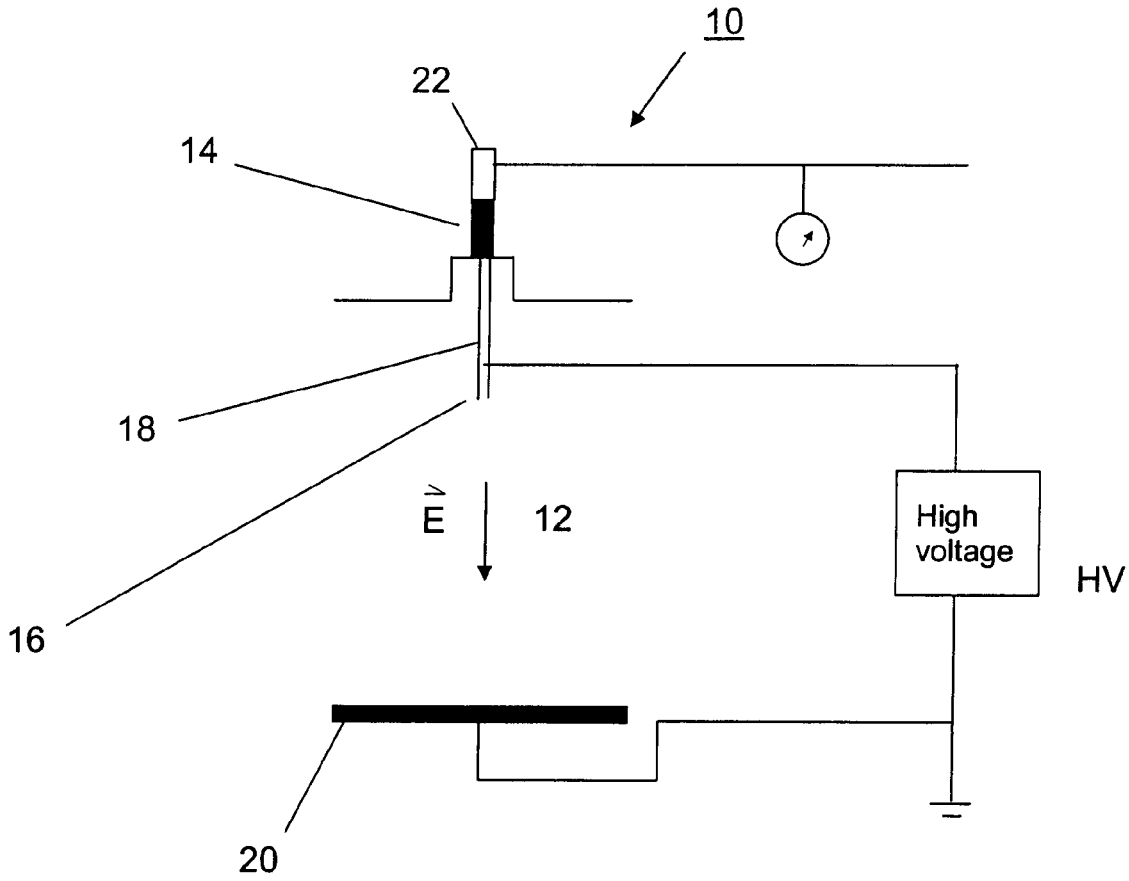
FIG. 1 is a schematic illustration of a conventional electrospinning apparatus.
Figure 2:
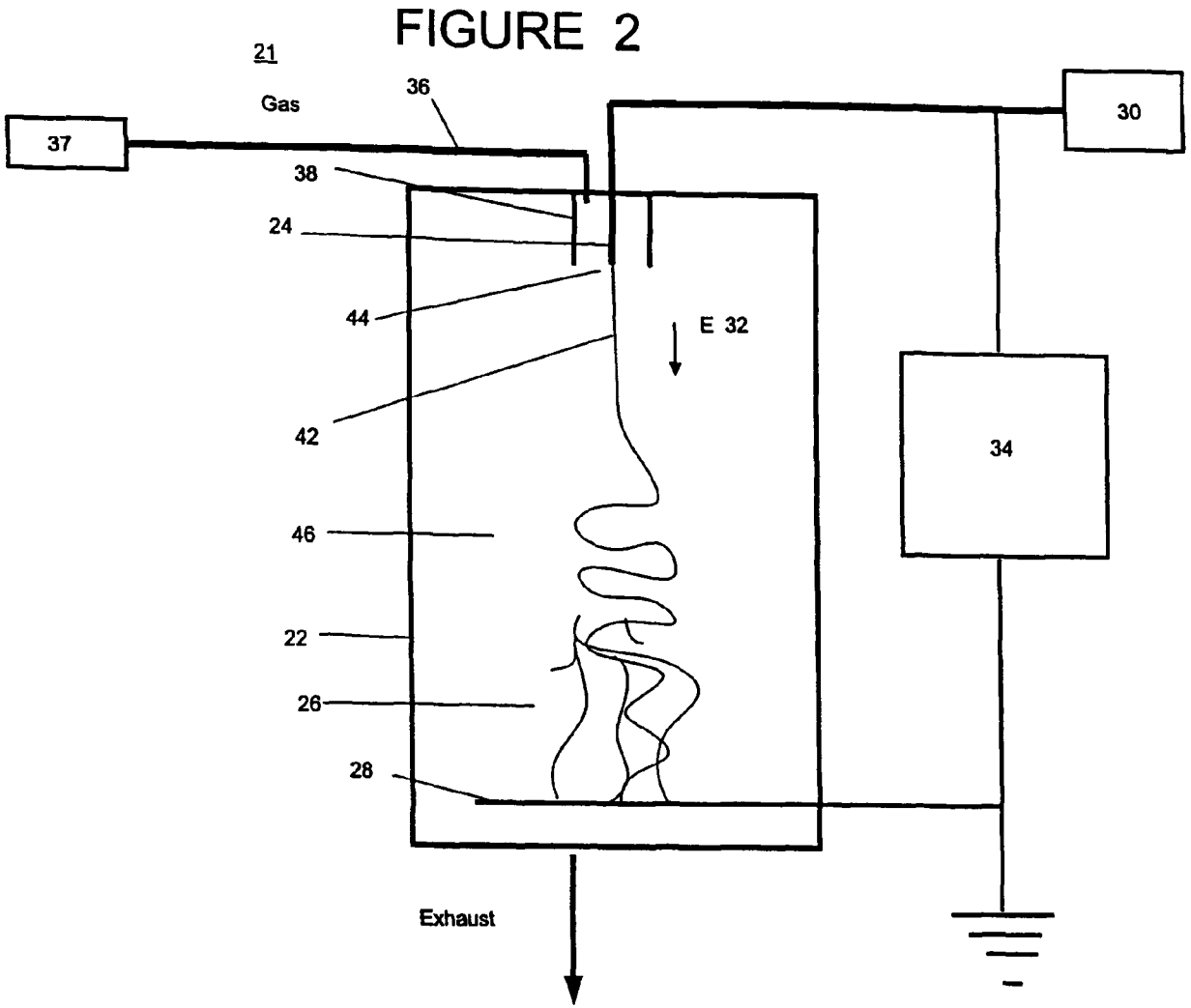
FIG. 2 is a schematic illustration of an electrospinning apparatus according to one embodiment the present invention in which a chamber encloses a spray head and collector of the electrospinning apparatus.

Referring now to the drawings, wherein like reference numerals designate identical, or corresponding parts throughout the several views, and more particularly to FIG. 2, FIG. 2 is a schematic illustration of an electrospinning apparatus 21 according to one embodiment the present invention in which a chamber 22 surrounds an electrospinning extrusion element 24. As such, the extrusion element 24 is configured to electrospin a substance from which fibers are composed to form fibers 26. The electrospinning element has an extrusion passage with an inner dimension in a range of 50-250 μm. The electrospinning element has an extrusion passage with an interior cross sectional area of 1,900-50,000 $\mu m^2$. The electrospinning apparatus 21 includes a collector 28 disposed from the extrusion element 24 and configured to collect the fibers. The chamber 22 about the extrusion element 24 is configured to inject charge carriers, such as for example electronegative gases, ions, and/or radioisotopes, into a gaseous environment in which the fibers 26 are electrospun. As to be discussed later, injection of the charge carriers into the gaseous environment in which the fibers 26 are electrospun broadens the process parameter space in which the fibers can be electrospun in terms of the concentrations of solutions and applied voltages utilized.

The extrusion element 24 communicates with a reservoir supply 30 containing the electrospray medium such as for example the above-noted polymer solution 14. The electrospray medium of the present invention includes polymer solutions and/or melts known in the art for the extrusion of fibers including extrusions of nanofiber materials. Indeed, polymers and solvents suitable for the present invention include for example polystyrene in dimethylformamide or toluene, polycaprolactone in dimethylformamide/methylene chloride mixture (20/80 w/w), poly(ethyleneoxide) in distilled water, poly(acrylic acid) in distilled water, poly(methyl methacrylate) PMMA in acetone, cellulose acetate in acetone, polyacrylonitrile in dimethylformamide, polylactide in dichloromethane or dimethylformamide, and poly(vinylalcohol) in distilled water. Thus, in general, suitable solvents for the present invention include both organic and inorganic solvents in which polymers can be dissolved.

The electrospray medium, upon extrusion from the extrusion element 24, is guided along a direction of an electric field 32 directed toward the collector 28. A pump (not shown) maintains a flow rate of the electrospray substance to the extrusion element 24 at a desired value depending on capillary diameter and length of the extrusion element 24, and depending on a viscosity of the electrospray substance. A filter can be used to filter out impurities and/or particles having a dimension larger than a predetermined dimension of the inner diameter of the extrusion element 24. The flow rate through the extrusion element 24 should be balanced with the electric field strength of the electric field 32 so that a droplet shape exiting a tip of the extrusion element 24 is maintained constant. Using the Hagen-Poisseuille law, for example, a pressure drop through a capillary having an inner diameter of 100 μm and a length of about 1 cm is approximately 100-700 kPa for a flow rate of 1 ml/hr depending somewhat on the exact value of viscosity of the electrospray medium.

Figure 3:
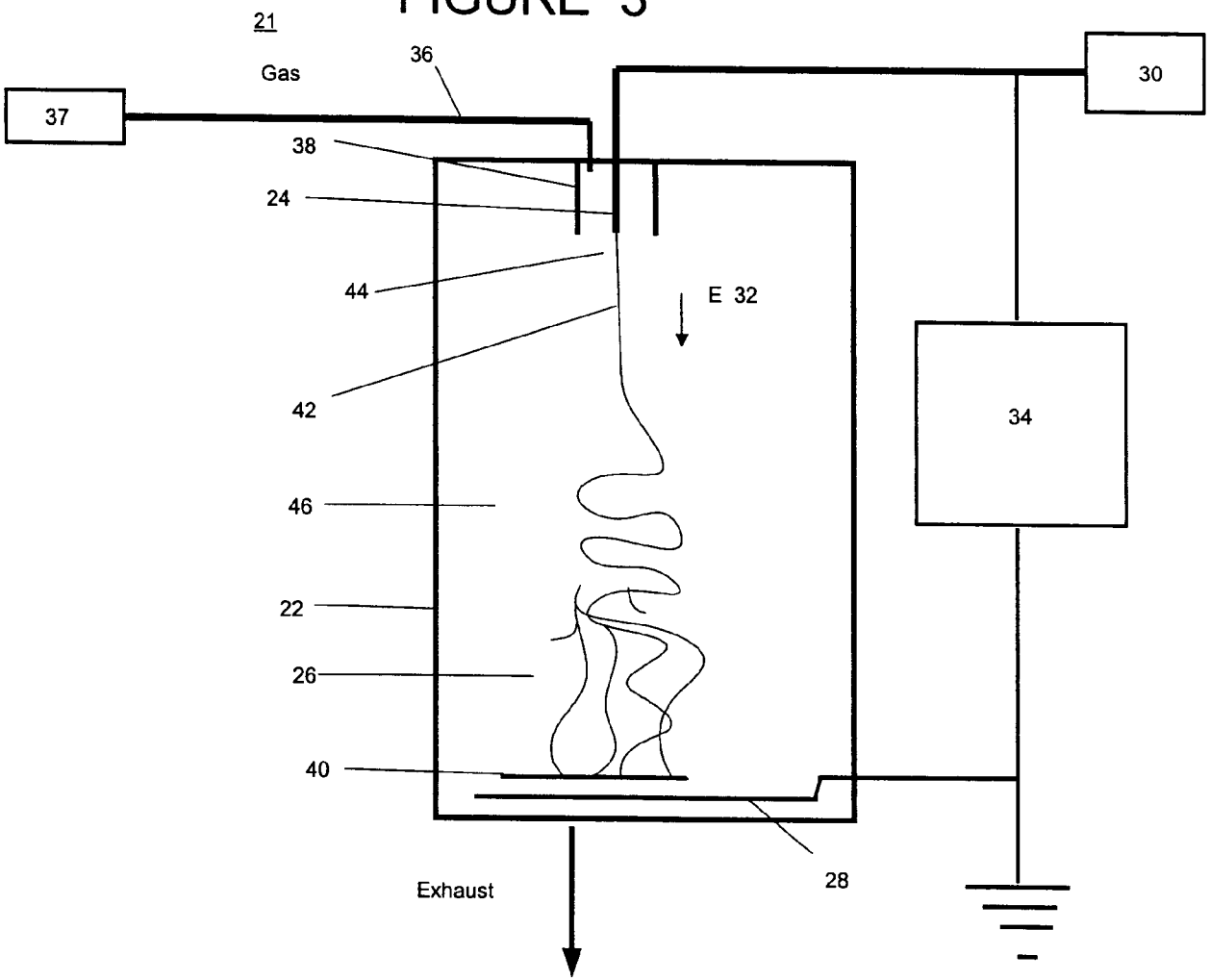
FIG. 3 is a schematic illustration of an electrospinning apparatus according to one embodiment the present invention having a collecting mechanism as the collector of the electrospinning apparatus.

A high voltage source 34 is provided to maintain the extrusion element 24 at a high voltage. The collector 28 is placed preferably 1 to 100 cm away from the tip of the extrusion element 24. The collector 28 can be a plate or a screen. Typically, an electric field strength between 2,000 and 400,000 V/m is established by the high voltage source 34. The high voltage source 34 is preferably a DC source, such as for example Bertan Model 105-20R (Bertan, Valhalla, N.Y.) or for example Gamma High Voltage Research Model ES30P (Gamma High Voltage Research Inc., Ormond Beach, Fla.). Typically, the collector 28 is grounded, and the fibers 26 produced by extrospinning from the extrusion elements 24 are directed by the electric field 32 toward the collector 28. As schematically shown in FIG. 3, the electrospun fibers 26 can be collected by a collecting mechanism 40 such as for example a conveyor belt. The collecting mechanism 40 can transfer the collected fibers to a removal station (not shown) where the electrospinning fibers are removed before the conveyor belt returns to collect more fibers. The collecting mechanism 40 can be a mesh, a rotating drum, or a foil besides the afore-mentioned conveyor belt. In another embodiment of the present invention, the electrospun fibers are deposited on a stationary collecting mechanism, accumulate thereon, and are subsequently removed after a batch process.

The distance between the tip of the extrusion element 24 and the collector 28 is determined based on a balance of a few factors such as for example a time for the solvent evaporation rate, the electric field strength, and a distance/time sufficient for a reduction of the fiber diameter. These factors and their determination are similar in the present invention to those in conventional electrospinning. However, the present inventors have discovered that a rapid evaporation of the solvents results in larger than nm-size fiber diameters.

Further, the differences in fluid properties of the polymer solutions utilized in electrospraying and those utilized in electrospraying, such as for example differences in conductivity, viscosity and surface tension, result in quite different gaseous environments about electrospraying and electrospinning apparatuses. For example, in the electrospray process, a fluid jet is expelled from a capillary at high DC potential and immediately breaks into droplets. The droplets may shatter when the evaporation causes the force of the surface charge to exceed the force of the surface tension (Rayleigh limit). Electrosprayed droplets or droplet residues migrate to a collection (i.e., typically grounded) surface by electrostatic attraction. Meanwhile, in electrospinning, the highly viscous fluid utilized is pulled (i.e., extracted) as a continuous unit in an intact jet because of the inter-fluid attraction, and is stretched as the pulled fiber dries and undergoes the instabilities described below. The drying and expulsion process reduces the fiber diameter by at least 1000 times. In electrospinning, the present invention recognizes that the complexities of the process are influenced by the gaseous atmospheres surrounding the pulled fiber, especially when polymer solutions with relatively low viscosities and solids content are to be used to make nanofibers (i.e., less than 100 nm in diameter).

With reference to FIG. 2, the electric field 32 pulls the substance from which the fiber is to be composed as a filament or liquid jet 42 of fluid from the tip of the extrusion element 24. A supply of the substance to each extrusion element 24 is preferably balanced with the electric field strength responsible for extracting the substance from which the fibers are to be composed so that a droplet shape exiting the extrusion element 24 is maintained constant.

A distinctive feature observable at the tip is referred to in the art as a Taylor's cone 44. As the liquid jet 42 dries, the charge per specific area increases. Often within 2 or 3 centimeters from the tip of the capillary, the drying liquid jet becomes electrically unstable in region referred to as a Rayleigh instability region 46. The liquid jet 42 while continuing to dry fluctuates rapidly stretching the fiber 26 to reduce the charge density as a function of the surface area on the fiber.

In one embodiment of the present invention, the electrical properties of the gaseous environment about the chamber 22 are controlled to improve the process parameter space for electrospinning. For example, electronegative gases impact the electrospinning process. While carbon dioxide has been utilized in electrospraying to generate particles and droplets of material, no effects prior to the present work have been shown for the utilization of electronegative gases in an electrospinning environment. Indeed, the nature of electrospinning in which liberal solvent evaporation occurs in the environment about the extrusion elements and especially at the liquid droplet at the tip of the extrusion element would suggest that the addition of electronegative gasses would not influence the properties of the spun fibers. However, the present inventors have discovered that the introduction into the gaseous environment of electronegative gases (e.g., carbon dioxide, sulfur hexafluoride, and freons, and gas mixtures including vapor concentration of solvents) improves the parameter space available for electrospinning fibers. Suitable electronegative gases for the present invention include $CO_2$, CO, $SF_6$, $CF_4$, $N_2O$, $CCl_4$, $CCl_3F$, $CCl_2F_2$ and other halogenerated gases.

By modifying the electrical properties of the gaseous environment about the extrusion element 24, the present invention permits increases in the applied voltage and improved pulling of the liquid jet 42 from the tip of the extrusion element 24. In particular, injection of electronegative gases appears to reduce the onset of a corona discharge (which would disrupt the electrospinning process) around the extrusion element tip, thus permitting operation at higher voltages enhancing the electrostatic force. Further, according to the present invention, injection of electronegative gases and as well as charge carriers reduces the probability of bleeding-off charge in the Rayleigh instability region 46, thereby enhancing the stretching and drawing of the fiber under the processing conditions.

As illustrative of the electrospinning process of the present invention, the following non-limiting example is given to illustrate selection of the polymer, solvent, a gap distance between a tip of the extrusion element and the collection surface, solvent pump rate, and addition of electronegative gases:

a polystyrene solution of a molecular weight of 350 kg/mol, a solvent of dimethylformamide DMF, an extrusion element tip diameter of 1000 μm, an Al plate collector, ~0.5 ml/hr pump rate providing the polymer solution, an electronegative gas flow of $CO_2$ at 8 lpm, an electric field strength of 2 KV/cm, and a gap distance between the tip of the extrusion element and the collector of 17.5 cm.

With these conditions as a baseline example, a decreased fiber size can be obtained according to the present invention, by increasing the molecular weight of the polymer solution to 1000 kg/mol, and/or introducing a more electronegative gas (such as for example Freon), and/or increasing gas flowrate to for example 20 lpm, and/or decreasing tip diameter to 150 μm (e.g. as with a Teflon tip). With most polymer solutions utilized in the present invention, the presence of $CO_2$ gas allowed electrospinning over a wide range of applied voltages and solution concentrations compared to spinning in presence of nitrogen gas. Thus, the gaseous environment surrounding the extrusion elements during electrospinning influences the quality of the fibers produced.

Further, blending gases with different electrical properties can be used to improve the processing window.

One example of a blended gas includes $CO_2$ (at 4 lpm) blended with Argon (at 4 lpm). Other examples of blended gases suitable for the present invention include, but are not limited to, $CO_2$ (4 lpm) with Freon (4 lpm), $CO_2$ (4 lpm) with Nitrogen (4 lpm), $CO_2$ (4 lpm) with Air (4 lpm), $CO_2$ (7 lpm) with Argon (1 lpm), $CO_2$ (1 lpm) with Argon (7 lpm).

As shown in FIG. 2, electronegative gases can be introduced by a port 36 which introduces gas by a flow controller 37 into the chamber 22 through a shroud 38 about the extrusion element 24. The port 36 is connected to an external gas source (not shown), and maintains a prescribed gas flow into the chamber 22. The external gas sources can be pure electronegative gases, mixtures thereof, or blended with other gases such as inert gases. The chamber 22 can contain the extrusion element 24, the collector 28, and other parts of the apparatus described in FIG. 2 are placed, and can have a vent to exhaust the gas and other effluents from the chamber 22.

Figure 4:
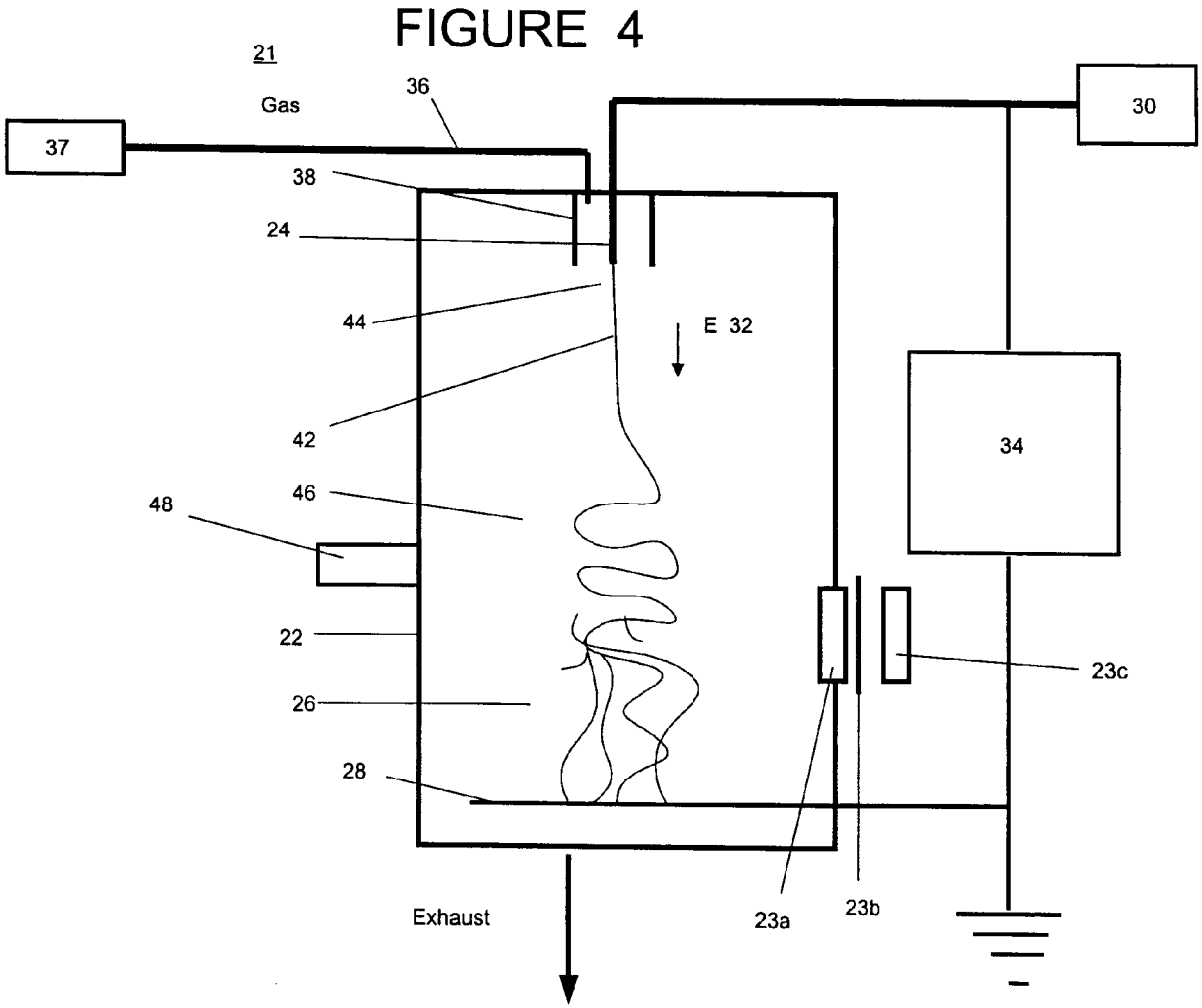
FIG. 4 is a schematic illustration of an electrospinning apparatus according to one embodiment of the present invention including an ion generator which generate ions for injection into a region where the fibers are being electrospun.

The present inventors have also discovered that the electrospinning process is affected by introducing charge carriers such as positive or negative ions, and energetic particles. FIG. 4 shows the presence of an ion generator 48 configured to generate ions for injection into the Rayleigh instability region 46. Extraction elements 49 as shown in FIG. 4 are used to control a rate of extraction and thus injection of ions into the gaseous environment in which the electrospinning is occurring. For example, in one embodiment to introduce ionic species, a corona discharge is used as the ion generator 48, and the ions generated in the corona discharge (preferably negative ions) would injected into the chamber 22.

Similarly, the present inventors have discovered that exposure of the chamber 22 to a radioisotope, such as for example Po 210 (a 500 microcurie source) available from NRD LLC., Grand Island, N.Y. 14072, affects the electrospinning process and in certain circumstances can even stop the electrospinning process. Accordingly, in one embodiment of the present invention as shown in FIG. 4, the chamber 22 includes a window 23*a* having a shutter 23*b*. The window 23*a* preferably made of a low mass number material such as for example teflon or kapton which will transmit energetic particles such as from radioisotopes generated in the radioisotope source 23*c* into the Rayleish instability region 46. The shutter 23*b* is composed of an energetic particle absorbing material, and in one embodiment is a variable vane shutter whose control determines an exposure of the chamber 22 to a flux of the energetic particles.

Further, the present inventors have discovered that retarding the drying rate is advantageous because the longer the residence time of the fiber in the region of instability the lower the electric field strength can be while still prolonging the stretching, and consequently improving the processing space for production of nanofibers. The height of the chamber 22 and the separation distance between a tip of the extrusion element 24 and the collector 28 are, according to the present invention, designed to be compatible with the drying rate of the fiber. The drying rate for an electrospun fiber during the electrospinning process can be adjusted by altering the partial pressure of the liquid vapor in the gas surrounding the fiber.

Figure 5:
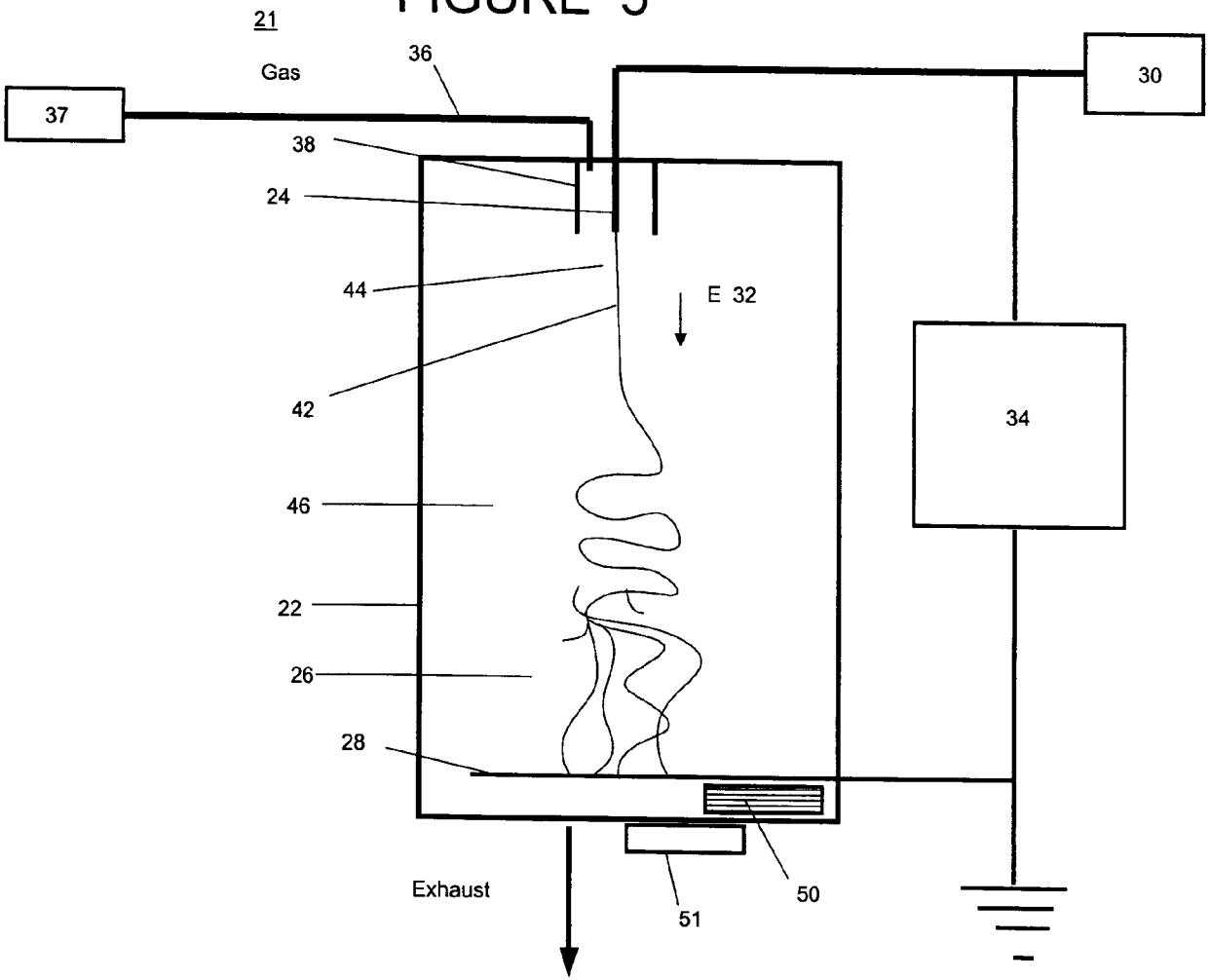
FIG. 5 is a schematic illustration of an electrospinning apparatus according to one embodiment of the present invention including a liquid pool.

For instance, when a solvent such as methylene chloride or a blend of solvents is used to dissolve the polymer, the rate of evaporation of the solvent will depend on the vapor pressure gradient between the fiber and the surrounding gas. The rate of evaporation of the solvent can be controlled by altering the concentration of a solvent vapor in the gas. The rate of evaporation also affects the Rayleigh instability. Additionally, the electrical properties of the solvent (in the gas phase) influence the electrospinning process. As shown in FIG. 5, by maintaining a liquid pool 50 at the bottom of the chamber 22, the amount of solvent vapor present in the ambient about the electrospinning environment can be controlled by altering a temperature of the chamber 22 and/or the solvent pool 50, thus controlling the partial pressure of solvent in the gaseous ambient in the electrospinning environment. Examples of temperature ranges and solvents suitable for the present invention are discussed below.

For temperature ranges from ambient to approximately 10° C. below the boiling point of the solvent, the following solvents are suitable:

Dimethylformamide: ambient to ~143° C.

Methylene chloride: ambient to ~30° C.

Water: ambient to ~100° C.

Acetone: ambient to ~46° C.

Solvent partial pressures can vary from near zero to saturation vapor pressure. Since saturation vapor pressure increases with temperature, higher partial pressures can be obtained at higher temperatures. Quantities of solvent in the pool vary with the size of the chamber and vary with the removal rate by the vent stream. For a chamber of about 35 liters, a solvent pool of a volume of approximately 200 ml can be used. Hence a temperature controller 51 as shown in FIG. 5 can control the temperature of the liquid in the vapor pool 50 and thus control the vapor pressure of the solvent in the chamber 22.

Hence, the present invention utilizes a variety of control mechanisms to control the gaseous environment in which the fibers are being electrospun for example to alter the electrical resistance of the environment or to control the drying rate of the electrospun fibers in the gaseous environment. The various control mechanisms include for example the afore-mentioned temperature controllers to control a temperature of a liquid in a vapor pool exposed to the gaseous environment, flow controllers to control a flow rate of an electronegative gas into the gaseous environment, extraction elements configured to control an injection rate of ions introduced into the gaseous environment, and shutters to control a flux of energetic particles into the gaseous environment. Other mechanisms known in the art for controlling the introduction of such species into a gaseous environment would also be suitable for the present invention.

While the effect of controlling the environment about an electrospinning extrusion element has been illustrated by reference to FIGS. 2-4, control of the environment is also important in other electrospinning apparatuses, such as for example the apparatuses shown in related provisional applications U.S. Ser. No. 10/819,916, filed on Apr. 8, 2004, entitled "Electrospinning of Polymer Nanofibers Using a Rotating Spray Head," now U.S. Pat. No. 7,134,857, and U.S. Ser. No. 10/819,942, filed on Apr. 8, 2004, entitled "Electrospraying/electrospinning Apparatus and Method," now U.S. Pat. No. 7,762,801.

Additionally, control of the gaseous environment in one embodiment of the present invention while improving the process window for electrospinning also homogenizes the gaseous environment in which the fibers are being drawn and dried. As such, the present invention provides apparatuses and methods by which fibers (and especially nanofibers) can more uniformly develop and thus be produced with a more uniform diameter size and distribution than that which would be expected in conventional electrospinning equipment with uncontrolled atmospheres.

Figure 6:
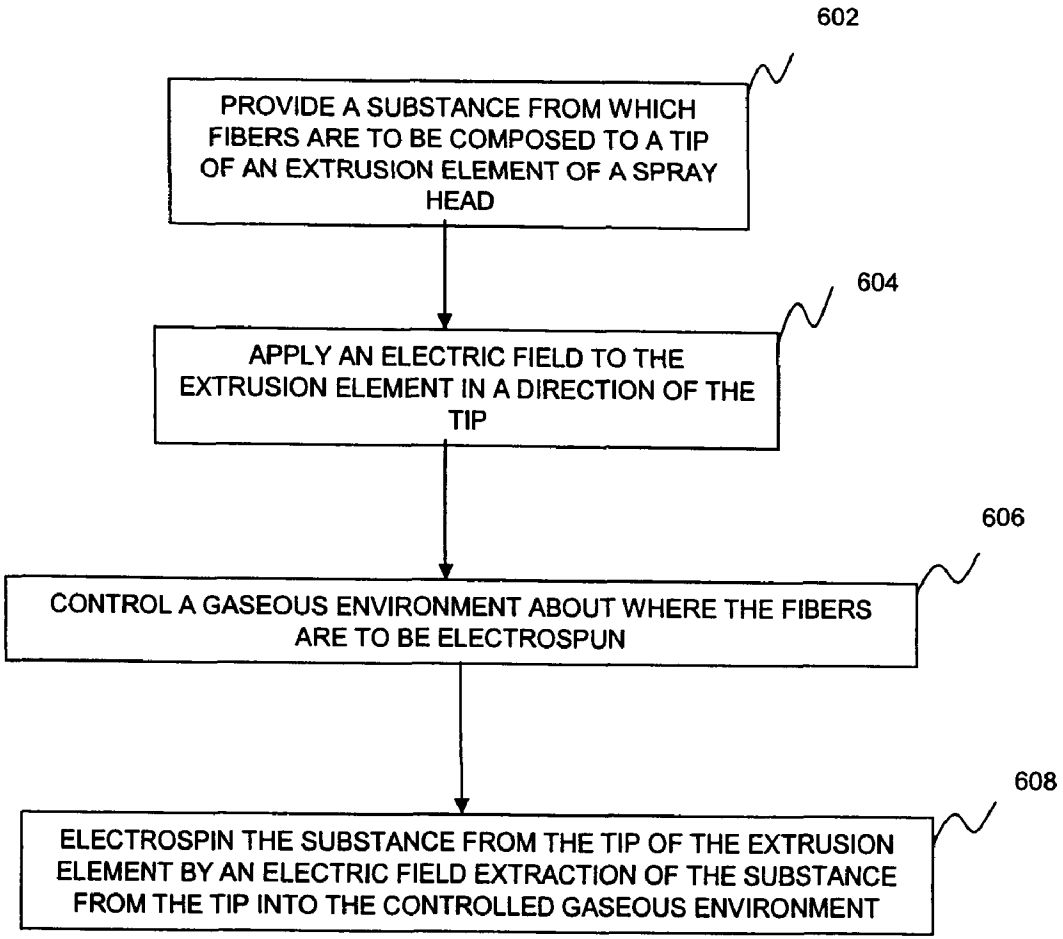
FIG. 6 is a flowchart depicting a method of the present invention.

Thus, as depicted in FIG. 6, one method of the present invention includes in step 602 providing a substance from which the fibers are to be composed to a tip of an extrusion element of a spray head. The method includes in step 604 applying an electric field to the extrusion element in a direction of the tip. The method includes in step 606 controlling a gaseous environment about where the fibers are to be electrospun. The method includes in step 608 electrospinning the substance from the tip of the extrusion element by an electric field extraction of the substance from the tip into the controlled gaseous environment.

In step 606, at least one of an electronegative gas, ions, and energetic particles are injected into the gaseous environment. Alternatively or in addition, electronegative gases such as $CO_2$, CO, $SF_6$, $CF_4$, $N_2O$, $CCl_4$, $CCl_3F$, and $C_2Cl_2F_2$, or mixtures thereof can be injected into the gaseous environment. When injecting ions, the ions can be generated in one region of the chamber 22 and injected into the gaseous environment. The injected ions are preferably injected into a Rayleigh instability region downstream from the extrusion element.

Further in step 606, the gaseous environment about where the fibers are to be electrospun can be controlled by introducing a vapor of a solvent into the chamber. The vapor can be supplied by exposing the chamber to a vapor pool of a liquid, including for example vapor pools of dimethyl formamide, methylene chloride, acetone, and water.

In step 608, the method preferably electrospins the substance in an electric field strength of 2,000-400,000 V/m. The electrospinning can produce either fibers or nanofibers.

The fibers and nanofibers produced by the present invention include, but are not limited to, acrylonitrile/butadiene copolymer, cellulose, cellulose acetate, chitosan, collagen, DNA, fibrinogen, fibronectin, nylon, poly(acrylic acid), poly (chloro styrene), poly(dimethyl siloxane), poly(ether imide), poly(ether sulfone), poly(ethyl acrylate), poly(ethyl vinyl acetate), poly(ethyl-co-vinyl acetate), poly(ethylene oxide), poly(ethylene terephthalate), poly(lactic acid-co-glycolic acid), poly(methacrylic acid) salt, poly(methyl methacrylate), poly(methyl styrene), poly(styrene sulfonic acid) salt, poly(styrene sulfonyl fluoride), poly(styrene-co-acrylonitrile), poly(styrene-co-butadiene), poly(styrene-co-divinyl benzene), poly(vinyl acetate), poly(vinyl alcohol), poly(vinyl chloride), poly(vinylidene fluoride), polyacrylamide, polyacrylonitrile, polyamide, polyaniline, polybenzimidazole, polycaprolactone, polycarbonate, poly(dimethylsiloxane-co-polyethyleneoxide), poly(etheretherketone), polyethylene, polyethyleneimine, polyimide, polyisoprene, polylactide, polypropylene, polystyrene, polysulfone, polyurethane, poly (vinylpyrrolidone), proteins, SEBS copolymer, silk, and styrene/isoprene copolymer.

Additionally, polymer blends can also be produced as long as the two or more polymers are soluble in a common solvent. A few examples would be: poly(vinylidene fluoride)-blend-poly(methyl methacrylate), polystyrene-blend-poly(vinylmethylether), poly(methyl methacrylate)-blend-poly(ethyleneoxide), poly(hydroxypropyl methacrylate)-blend poly (vinylpyrrolidone), poly(hydroxybutyrate)-blend-poly (ethylene oxide), protein blend-polyethyleneoxide, polylactide-blend-polyvinylpyrrolidone, polystyrene-blend-polyester, polyester-blend-poly(hyroxyethyl methacrylate), poly(ethylene oxide)-blend poly(methyl methacrylate), poly (hydroxystyrene)-blend-poly(ethylene oxide)).

By post treatment annealing, carbon fibers can be obtained from the electrospun polymer fibers.

Numerous modifications and variations of the present invention are possible in light of the above teachings. It is therefore to be understood that within the scope of the appended claims, the invention may be practiced otherwise than as specifically described herein.

The invention claimed is:

1. An apparatus for producing fibers, comprising:

an electrospinning element having an electrified tip, and configured to electrospin a substance from which the fibers are to be composed by an electric field extraction of the substance from the tip of the electrospinning element;

said electrified tip of the electrospinning element producing an electric field having an electric field strength such that a flow rate of the substance to the electrospinning element is balanced with the electric field strength responsible for extracting the substance from which the fibers are to be composed so that a droplet shape of the substance exiting the electrified tip is maintained;

a collector disposed from the electrospinning element and configured to collect the fibers;

a chamber enclosing the collector and the electrospinning element;

a shroud extending from an interior wall of the chamber and partially enclosing the electrospinning element; and a control mechanism configured to control a gaseous environment in which the fibers are to be electrospun.

2. The apparatus of claim 1, wherein the control mechanism is configured to control a drying rate of electrospun fibers.

3. The apparatus of claim 2, further comprising:

a vapor pool containing at least one of an inorganic and organic liquid; and said control mechanism comprises a temperature controller configured to control a temperature of the liquid in the vapor pool.

4. The apparatus of claim 3, wherein the liquid comprises at least one of dimethyl formamide, methylene chloride, acetone, and water.

5. The apparatus of claim 4, wherein the temperature controller is configured to control a temperature of the liquid to provide a predetermined vapor pressure of the liquid to the gaseous environment.

6. The apparatus of claim 5, wherein the temperature controller is configured to control the temperature from an ambient temperature to 10° C. below a boiling point of the liquid.

7. The apparatus of claim 1, wherein the control mechanism is configured to control an injection of species altering an electrical resistance of the gaseous environment in which the fibers are electrospun.

8. The apparatus of claim 7, wherein the control mechanism is configured to control the injection of at least one of an electronegative gas, a vapor, ions, and energetic particles.

9. The apparatus of claim 8, wherein the chamber is connected to a supply of the electronegative gas.

10. The apparatus of claim 9, wherein the control mechanism comprises a flow controller configured to control a flow rate of the electronegative gas into the chamber.

11. The apparatus of claim 9, wherein the chamber is connected to a supply of at least one of $CO_2$, CO, $SF_6$, $CF_4$, $N_2O$, $CCl_4$, $CCl_3F$, and $C_2Cl_2F_22$.

12. The apparatus of claim 8, wherein the shroud is connected to a supply of the electronegative gas.

13. The apparatus of claim 12, wherein the control mechanism comprises a flow controller configured to control a flow rate of the electronegative gas into the shroud.

14. The apparatus of claim 12, wherein the shroud is connected to a supply of at least one of $CO_2$, CO, $SF_6$, $CF_4$, $N_2O$, $CCl_4$, $CCl_3F$, and $C_2Cl_2F_2$.

15. The apparatus of claim 8, further comprising:

a radioisotope source of the energetic particles, the control mechanism comprises a shutter configured to control an exposure of the chamber to the radioisotope source, said shutter comprising an energetic particle absorbing material.

16. The apparatus of claim 8, further comprising:

an ion generator configured to generate the ions; and the control mechanism comprising extraction elements configured to control a rate of extraction of the ions from the ion generator into the gaseous environment.

17. The apparatus of claim 16, wherein the ion generator is configured to inject ions into a Rayleigh instability region in which the fibers are electrospun.

18. The apparatus of claim 1, wherein the chamber is connected to a supply of gas.

19. The apparatus of claim 18, further comprising:

a flow controller configured to control a flow rate of the gas into the chamber.

20. The apparatus of claim 1, wherein the shroud about the electrospinning element is connected to a supply of gas.

21. The apparatus of claim 20, wherein the control mechanism comprises a flow controller configured to control a flow rate of the gas into the shroud.

22. The apparatus of claim 1, wherein the electrospinning element comprises a plurality of electrospinning elements.

23. The apparatus of claim 1, wherein the collector comprises at least one of a plate and a screen.

24. The apparatus of claim 1, wherein the collector comprises an electrical ground.

25. The apparatus of claim 1, wherein the collector is disposed 1-100 cm from said electrospinning element.

26. The apparatus of claim 1, further comprising:

a power source electrically connected across said electrospinning element and said collector.

27. The apparatus of claim 26, wherein the power source is configured to generate for said electric field a strength of 2,000-400,000 V/m between said electrospinning element and said collector.

28. The apparatus of claim 1, wherein the electrospinning element has an extrusion passage with an inner dimension in a range of 50-250 μM.

29. The apparatus of claim 1, wherein the electrospinning element has an extrusion passage with an interior cross sectional area of 1,900-50,000 $\mu m^2$.

30. An apparatus for producing fibers, comprising:

an electrospinning element having an electrified tip, and configured to electrospin a substance from which the fibers are to be composed by an electric field extraction of the substance from the electrified tip of the electrospinning element;

said electrified tip of the electrospinning element producing an electric field having an electric field strength such that a flow rate of the substance to the electrospinning element is balanced with the electric field strength responsible for extracting the substance from which the fibers are to be composed so that a droplet shape of the substance exiting the electrified tip is maintained;

a collector disposed from the electrospinning element and configured to collect the fibers;

a chamber enclosing the collector and the electrospinning element;

a shroud extending from an interior wall of the chamber and partially enclosing the electrospinning element; and means for injecting a species to alter an electrical resistance of a gaseous environment in which the fibers are electrospun.

31. The apparatus of claim 30, wherein the means for injecting comprises:

means for injecting at least one of an electronegative gas, a vapor, ions, and energetic particles.

32. The apparatus of claim 31, wherein said means for injecting an electronegative gas comprises:

the chamber about said electrospinning element and configured to introduce the electronegative gas into the chamber.

33. The apparatus of claim 31, wherein said means for injecting comprises:

an ion generator configured to generate the ions.

34. The apparatus of claim 33, wherein the ion generator is configured to inject ions into a Rayleigh instability region in which the fibers are electrospun.

35. An apparatus for producing fibers, comprising:

an electrospinning element having an electrified tip, and configured to electrospin a substance from which the fibers are to be composed by an electric field extraction of the substance from the electrified tip of the electrospinning element;

said electrified tip of the electrospinning element producing an electric field having an electric field strength such that a flow rate of the substance to the electrospinning element is balanced with the electric field strength responsible for extracting the substance from which the fibers are to be composed so that a droplet shape of the substance exiting the electrified tip is maintained;

a collector disposed from the electrospinning element and configured to collect the fibers;

a chamber enclosing the collector and the electrospinning element;

a shroud extending from an interior wall of the chamber and partially enclosing the electrospinning element; and means for controlling a drying rate of electrospun fibers in a gaseous environment in which the fibers are electrospun.

36. The apparatus of claim 35, wherein the means for controlling comprises:

a temperature controller configured to control a temperature of at least one of an inorganic and organic liquid in a vapor pool exposed to the gaseous environment.

37. The apparatus of claim 36, wherein the liquid comprises at least one of dimethyl formamide, methylene chloride, acetone, and water.

38. The apparatus of claim 36, wherein the temperature controller is configured to control the temperature from an ambient temperature to 10° C. below a boiling point of the liquid in the vapor pool.

* * * * *